US011107392B2

(12) United States Patent
Li et al.

(10) Patent No.: US 11,107,392 B2
(45) Date of Patent: Aug. 31, 2021

(54) DISPLAY PANEL AND ELECTRONIC DEVICE

(71) Applicant: BEIJING XIAOMI MOBILE SOFTWARE CO., LTD., Beijing (CN)

(72) Inventors: Jian Li, Beijing (CN); Lei Tang, Beijing (CN); Sai Liu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/928,923

(22) Filed: Jul. 14, 2020

(65) Prior Publication Data

US 2021/0158746 A1 May 27, 2021

(30) Foreign Application Priority Data

Nov. 21, 2019 (CN) ..... 201911148760.6

(51) Int. Cl.
*G09G 3/32* (2016.01)

(52) U.S. Cl.
CPC ..... *G09G 3/32* (2013.01); *G09G 2300/0452* (2013.01)

(58) Field of Classification Search
CPC ..... G09G 3/32; G09G 2300/0452
See application file for complete search history.

(56) References Cited

U.S. PATENT DOCUMENTS

2010/0134524 A1* 6/2010 Hayashi ..... G02F 1/133621 345/690
2014/0240300 A1* 8/2014 Katsuta ..... G09G 3/3677 345/204
2015/0255012 A1* 9/2015 Gu ..... H01L 27/3244 345/83
2016/0259449 A1* 9/2016 Mizuhashi ..... G06F 3/0443
2017/0061890 A1* 3/2017 Zhou ..... G09G 3/3266
2018/0197471 A1* 7/2018 Rotzoll ..... H01L 25/167

FOREIGN PATENT DOCUMENTS

CN 107610635 A 1/2018
CN 110232892 A 9/2019
CN 110265455 A 9/2019
EP 1679687 A2 7/2006

OTHER PUBLICATIONS

Extended European Search Report issued in European Application No. 20190651.8 dated Apr. 12, 2020, (9p).

* cited by examiner

*Primary Examiner* — Muhammad N Edun
(74) *Attorney, Agent, or Firm* — Arch & Lake LLP

(57) ABSTRACT

A display panel and an electronic device are provided. The display panel comprises: a light-transmissive display area that comprises first pixel driving circuits; a first pixel array comprising an alternating light-emitting region. The alternating light-emitting region includes a plurality of sub-pixel groups, the plurality of sub-pixel groups include at least two colors, and each one of the plurality of sub-pixel groups includes at least one sub-pixel of the same color, at least two sub-pixel groups of the same color are connected in parallel to the same one of said first pixel driving circuits. The light-transmissive display includes a plurality of switching circuits. Each one of the plurality of switching circuits is connected with corresponding sub-pixel groups and first pixel driving circuit. The display panel also includes a control circuit connected with the plurality of the switching circuits and the first pixel driving circuits.

20 Claims, 7 Drawing Sheets

DISPLAY PANEL AND ELECTRONIC DEVICE

CROSS-REFERENCE TO RELATED APPLICATION

This application is based upon and claims priority to Chinese Patent Application No. 201911148760.6, filed on Nov. 21, 2019, the entire contents of which are incorporated herein by reference for all purposes.

TECHNICAL FIELD

The present disclosure relates to the technical field of terminals, and in particular, to a display panel and an electronic device.

BACKGROUND

With the rapid development of electronic equipment, users' requirements for screen-to-body ratio are getting higher and higher, so that a full-screen display of electronic equipment has received more and more attention from the industry. In order to increase the screen-to-body ratio of the display panel, in the related art, a photosensitive device can be placed under the display panel, and a corresponding display area is made into a light-transmissive display area, which also brings new challenges. That is to say, how to make ensure both light-transmissive performance and display performance of the light-transmissive display area have become technical problems that designers urgently need to solve.

SUMMARY

The present disclosure provides a display panel and an electronic device to solve the deficiencies in the related art.

According to a first aspect of the present disclosure, a display panel is provided. The display panel includes: a light-transmissive display area, which comprising: first pixel driving circuits; a first pixel array, comprising an alternating light-emitting region, the alternating light-emitting region includes a plurality of sub-pixel groups, the plurality of sub-pixel groups include at least two colors, and the sub-pixel group includes at least one sub-pixel of the same color, at least two sub-pixel groups of the same color are connected in parallel to the same one of said first pixel driving circuits; a plurality of switching circuits, each one of the plurality of switching circuits is connected with corresponding sub-pixel groups and first pixel driving circuit. The display panel also includes a control circuit configured to connect with the plurality of the switching circuits and the first pixel driving circuits, and the control circuit is configured to control at least two switching circuits connected with the sub-pixel groups of the same color to alternately turn on and control the first pixel driving circuits to make the sub-pixel groups of the same color in the alternating light-emitting region to emit light alternately.

According to a second aspect of the present disclosure, an electronic device is provided, including: the display panel according to any one of the embodiments described above; a photosensitive device, a photosensitive area of the photosensitive device is set to correspond to the light-transmissive display area.

It should be understood that the above general description and the following detailed description are merely exemplary and explanatory and should not be construed as limiting of the disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Exemplary embodiments will be described in detail herein, examples of which are illustrated in the accompanying drawings. When the following description refers to the accompanying drawings, the same numbers in different drawings represent the same or similar elements unless otherwise indicated. The implementations described in the following exemplary embodiments do not represent all implementations consistent with the present disclosure. Rather, they are merely examples of devices and methods consistent with some aspects of the present disclosure, as detailed in the appended claims.

The terminology used in this disclosure is for the purpose of describing particular embodiments only and is not intended to limit the disclosure. As used in this disclosure and the appended claims, the singular forms 'a', 'the' and 'said' are intended to include the plural forms as well, unless the context clearly indicates otherwise. It should also be understood that the term 'and/or' as used herein refers to and includes any or all possible combinations of one or more of the associated listed items.

It should be understood that, although the terms first, second, third, etc. may be used in this disclosure to describe various information, such information should not be limited to these terms. These terms are only used to distinguish the same type of information from each other. For example, without departing from the scope of the present disclosure, the first information may also be referred to as the second information, and similarly, the second information may also be referred to as the first information. Depending on the context, the word 'if' as used herein can be interpreted as 'as' or 'when' or 'in response to . . . to determine'.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Figure 1:
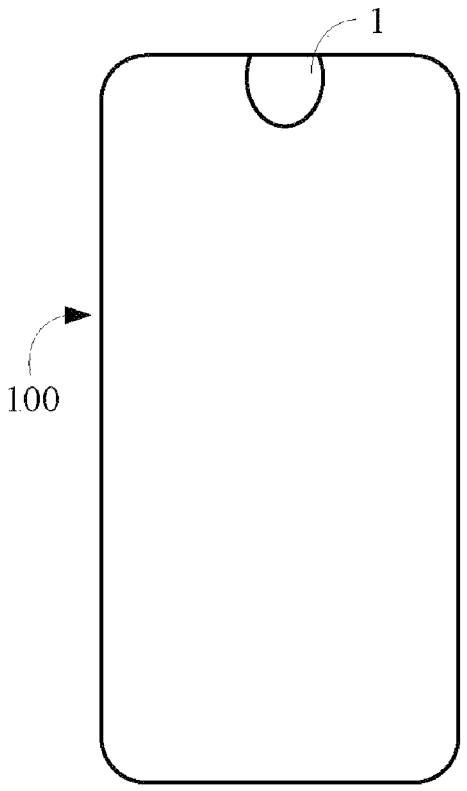
FIG. 1 is a schematic structural diagram of a display panel according to an example.
Figure 2:
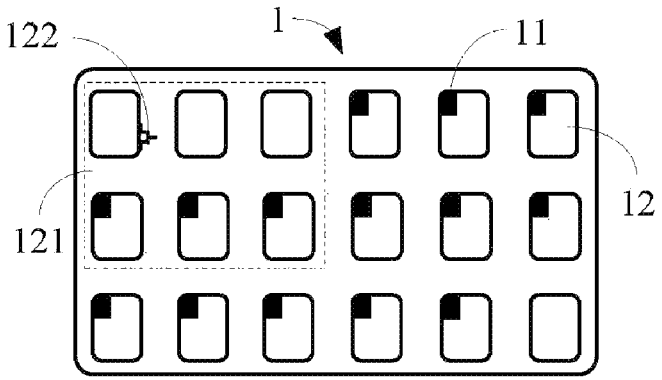
FIG. 2 is a pixel arrangement diagram of a light-transmissive display area according to an example.
Figure 3:
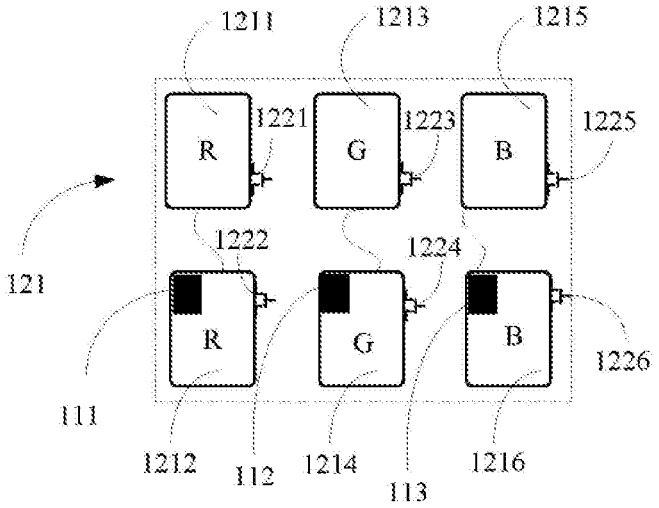
FIG. 3 is a structural schematic diagram of an alternating light-emitting region according to an example.

FIG. 1 is a schematic structural diagram of a display panel 100 according to an example, and FIG. 2 is a pixel arrangement diagram of a light-transmissive display area according to an example. As shown in FIG. 1, the display panel 100 may include a light-transmissive display area 1. As shown in FIG. 2, the light-transmissive display area 1 may include a first pixel driving circuit 11 and a first pixel array 12. Of course, as shown in FIG. 2, according to design requirements, the light-transmissive display area 1 may include a plurality of first pixel driving circuits 11. The first pixel array 12 may include a plurality of sub-pixels, and an alternating light-emitting region 121 in FIG. 2 can be composed of a part of the plurality of sub-pixels. As shown in FIG. 3, the alternating light-emitting region 121 may include a plurality of sub-pixel groups, and the plurality of sub-pixel groups may include at least two colors. Each one of the plurality of sub-pixel group 1211 may include one or more sub-pixels of the same color. At least two sub-pixel groups of the same color may be connected in parallel to the same one of the plurality of first pixel driving circuits 11; the light-transmissive display area 1 may further include a plurality of switching circuits 122, each of the plurality of switching circuits is connected with corresponding ones of the sub-pixel groups and the first pixel driving circuits.

For example, as shown in FIG. 3, it can be assumed that the alternating light-emitting region 121 may include a first sub-pixel group 1211 and a second sub-pixel group 1212 of the same color, a third sub-pixel group 1213 and a fourth sub-pixel group 1214 of the same color, and a fifth sub-pixel group 1215 and a sixth sub-pixel group 1216 of the same color. The first pixel driving circuits 11 may include a first driving circuit 111, a second driving circuit 112, and a third driving circuit 113. A plurality of switching circuits 122 may include a first switching circuit 1221, a second switching circuit 1222, a third switching circuit 1223, a fourth switching circuit 1224, a fifth switching circuit 1225, and a sixth switching circuit 1226. The first sub-pixel group 1211 and the second sub-pixel group 1212 are connected in parallel to the first driving circuit 111. The third sub-pixel group 1213 and the fourth sub-pixel group 1214 are connected in parallel to the second driving circuit 112. The fifth sub-pixel group 1215 and the sixth sub-pixel group 1216 are connected in parallel to the third driving circuit 113. The first switching circuit 1221 is connected with the first sub-pixel group 1211 and the first driving circuit 111. The second switching circuit 1222 is connected with the second sub-pixel group 1212 and the first driving circuit 111. The third switching circuit 1223 is connected with the third sub-pixel group 1213 and the second driving circuit 112. The fourth switching circuit 1224 is connected with the fourth sub-pixel group 1214 and the second driving circuit 112. The fifth switching circuit 1225 is connected with the fifth sub-pixel group 1215 and the third driving circuit 113. The sixth switching circuit 1226 is connected with the sixth sub-pixel group 1216 and the third driving circuit 113. Based on this, by connecting the sub-pixel groups of the same color in parallel, the number of first pixel driving circuits 11 in the alternating light-emitting region 121 is decreased and the area occupied by the first pixel driving circuits 11 in the alternating light-emitting region 121 can be reduced, compared with the technical solution in which each sub-pixel corresponds to one pixel driving circuit in the related art, thereby helping to improve the light transmittance of the light-transmissive display area 1. Furthermore, since each one of the sub-pixel groups of the same color is connected to one switching circuit 122 respectively, so that every sub-pixel group can be controlled individually by the switch circuit 122, thereby achieving emitting light alternately (described in detail later). The switching circuits 122 may include one of 2T1C, 3T1C, 4T1C, 5T1C, 6T1C, and 7T1C, and the disclosure is not limited thereto. The 7T1C is a typical internal compensation circuit, which consists of 7 Thin Film Transistors (TFTs) and 1 storage capacitor.

Figure 4:
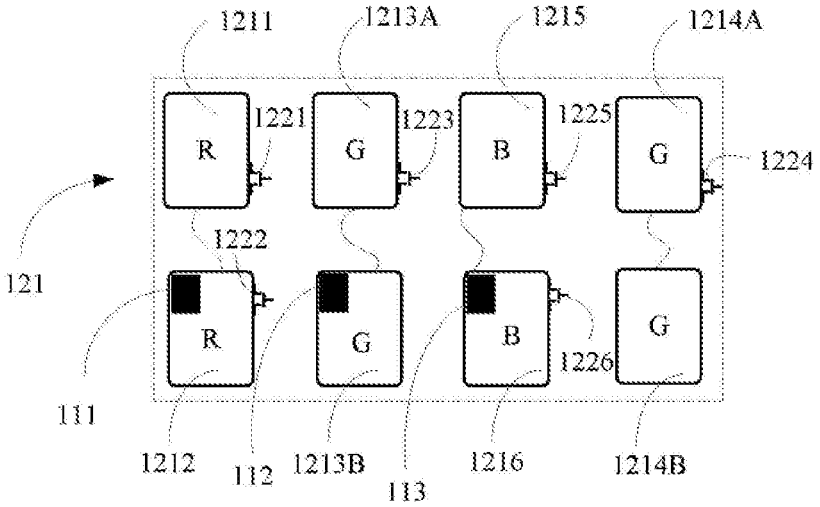
FIG. 4 is a structure schematic diagram of an alternating light-emitting region according to an example.

In the embodiment of FIG. 3, an example is described in which each sub-pixel group includes one sub-pixel. In fact, as shown in FIG. 4, the sub-pixel group may include a plurality of sub-pixels. Still shown in FIG. 4, in this embodiment, the third sub-pixel group 1213 may include a first sub-pixel 1213A and a second sub-pixel 1213B, and the fourth sub-pixel group 1214 may include a third sub-pixel 1214A and a fourth sub-pixel 1214B, in which the third sub-pixel group 1213 and the fourth sub-pixel group 1214 are connected in parallel to the second driving circuit 112, and the first sub-pixel 1213A and the second sub-pixel 1213B share the same switching circuit 1223 and the third sub-pixel 1214A and the fourth sub-pixel 1214B share the same switching circuit 1224.

Figure 5:
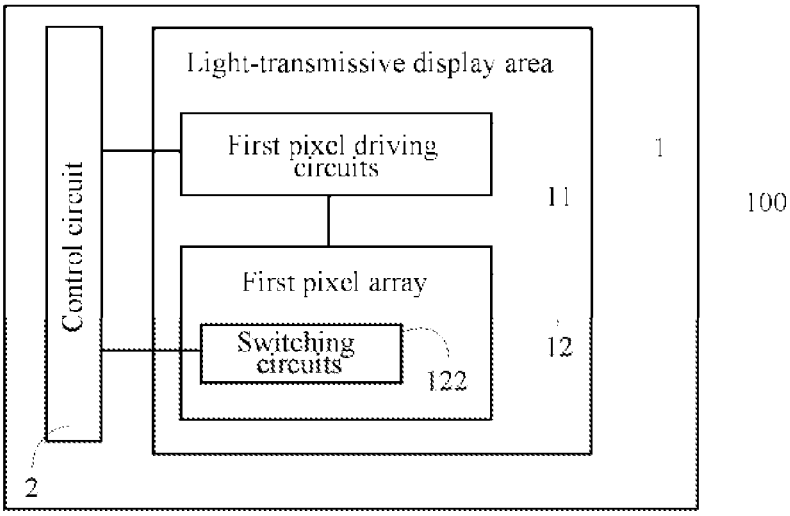
FIG. 5 is a structural block diagram of a display panel according to an example.

In the embodiments shown in FIG. 3 and FIG. 4, in order to realize the alternating light-emitting display of the alternating light-emitting region 121, the display panel 100 may further include a control circuit 2, and the control circuit 2 is connected with a plurality of switching circuits 122 and the first pixel driving circuits 11, as shown in FIG. 5. The control circuit 2 can be used to control at least two switching circuits connected with sub-pixel groups of the same color to turn on alternately, and control the first pixel driving circuits 11 so that sub-pixel groups of the same color in the alternating light-emitting region emit light alternately.

For example, as shown in FIGS. 3 and 4, the control circuit 2 is connected with the first switching circuit 1221, the second switching circuit 1222, the third switching circuit 1223, the fourth switching circuit 1224, the fifth switching circuit 1225, the sixth switching circuit 1226, the first driving circuit 111, the second driving circuit 112, and the third driving circuit 113, respectively. The control circuit 2 can make the first sub-pixel group 1211 and the second sub-pixel group 1212 to emit light alternately, by controlling the first switching circuit 1221, the second switching circuit 1222, and the first driving circuit 111. Similarly, the control circuit 2 can make the third sub-pixel group 1213 and the fourth sub-pixel group 1214 to emit light alternately, by controlling the third switching circuit 1223, the fourth switching circuit 1224, and the second driving circuit 112. The control circuit 2 can make the fifth sub-pixel group 1215 and the sixth sub-pixel group 1216 to emit light alternately, by controlling the fifth switch circuit 1225, the sixth switch circuit 1226, and the third driving circuit 113.

Therefore, by controlling the sub-pixel groups of the same color in the alternating light-emitting region 121 via the control circuit 2 to emit light alternately, two different images can be obtained alternately, and then superimpose these two different images, which can reduce the number of the first pixel driving circuits 11 in the alternating light-emitting region 121, while improving the image resolution of the light-transmissive display area 1 and the visual experience of the user.

As shown in FIG. 4, in this embodiment, in the case where the sub-pixel group includes a plurality of sub-pixels, the plurality of sub-pixels may be connected in series to the same switching circuit 122 as shown in FIG. 4, so as to control the plurality of sub-pixels to emit light or do not emit light at the same time by the switching circuit 122. That is, in the embodiment shown in FIG. 4, the first sub-pixel 1213A and the second sub-pixel 1213B are connected in series to the third switching circuit 1223, and the third sub-pixel 1214A and the fourth sub-pixel 1214B are connected in series to the fourth switching circuit 1224. Of course, in other embodiments, the first sub-pixel 1213A and the fourth sub-pixel 1214B are connected in series to the same switching circuit, and the second sub-pixel 1213B and the third sub-pixel 1214A are connected in series to the same switching circuit. There has many other series connection, this disclosure does not limit this.

Figure 6:
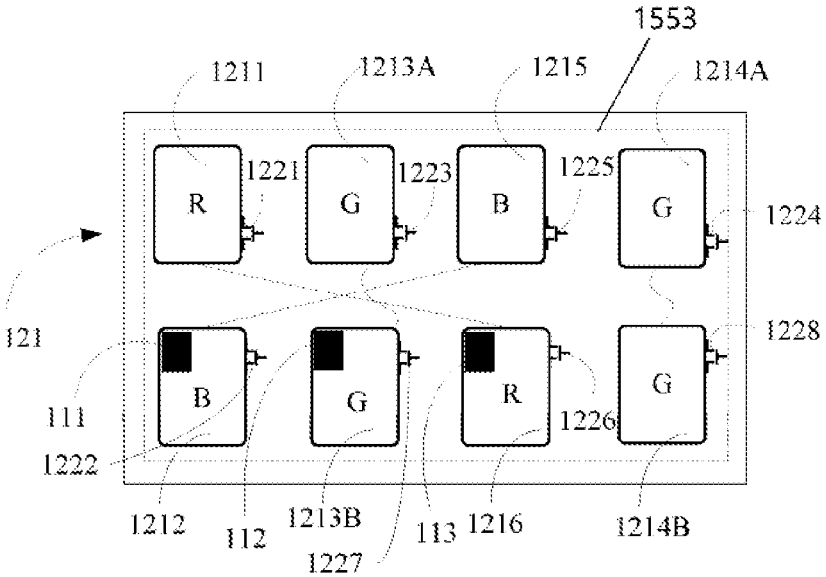
FIG. 6 is a structural schematic diagram of an alternating light-emitting region according to an example.

As shown in FIG. 6, in another embodiment, in a case where the sub-pixel group includes a plurality of sub-pixels, the plurality of sub-pixels may be connected in parallel, and each sub-pixel is connected to one switching circuit 122. The light-emitting state of the sub-pixel can be controlled by the corresponding switching circuit 122. For example, the third sub-pixel group 1213 may include a first sub-pixel 1213A and a second sub-pixel 1213B, and the fourth sub-pixel group 1214 may include a third sub-pixel 1214A and a fourth sub-pixel 1214B. Furthermore, the first sub-pixel 1213A and the second sub-pixel 1213B are connected in parallel, and the third sub-pixel 1214A and the fourth sub-pixel 1214B are connected in parallel. In order to be able to control each sub-pixel individually, the plurality of switching circuits 122 may further include a seventh switching circuit 1227 and an eighth switching circuit 1228. The first sub-pixel 1213A is connected with the third switching circuit 1223, and the second sub-pixel 1213B is connected with the seventh switching circuit 1227. The third sub-pixel 1214A is connected with the fourth switching circuit 1224, and the fourth sub-pixel 1214B is connected with the eighth switching circuit 1228.

In the embodiments shown in FIG. 3, FIG. 4, and FIG. 5, the connection between sub-pixel groups located in different rows is taken as an example for description. However, it can be understood that the alternating light-emitting region 121 may also include connections between the sub-pixel groups located in the same row, and the sub-pixel groups located in the same row are controlled to alternately emit light by the control circuit 2, which is not limited in the present disclosure. Further, as shown in FIGS. 4 and 5, when sub-pixels connected in series or in parallel with each other are included in the same sub-pixel group, sub-pixels located in different rows may be connected in series. Alternatively, in other embodiments, sub-pixels located in the same row may be connected in series. For example, in FIG. 5, the third sub-pixel group 1213 may include the first sub-pixel 1213A and the third sub-pixel 1214A, and the fourth sub-pixel group 1214 may include the second sub-pixel 1213B and the fourth sub-pixel 1214B. The first sub-pixel 1213A and the third sub-pixel 1214A may be connected in series or in parallel, and the second sub-pixel 1213B and the fourth sub-pixel 1214B may be connected in series or in parallel.

It should be noted that, among primary colors of the light-emitting units constituting the display panel 100, the naked eye is most sensitive to green. Therefore, in one light-emitting process of the alternating light-emitting region 121, each light-emitting unit may include a plurality of green sub-pixels, that is, when a sub-pixel group includes a plurality of sub-pixels connected in series with each other, the sub-pixel group may be green sub-pixel group. The switching circuits 122 described in the above embodiment may include one or more transistors, and may specifically be designed as required, which is not limited in the present disclosure.

Based on the above embodiments, in the technical solution provided in the present disclosure, since the sub-pixel groups of the same color need to be connected in parallel, thus there will be two or more sub-pixel groups of the same color in each alternating light-emitting region 121, i.e. the number of the sub-pixel groups of the same color in each alternating light-emitting region 121 will be two or more. Furthermore, according to different pixel arrangement rules of the light-transmissive display area 1, the alternating light-emitting region 121 may include different numbers of minimum repeating units. The pixel distribution of the entire first pixel array 12 can be obtained by constantly repeating the minimum repeating unit.

In an embodiment, the colors of the minimum repeating units corresponding to the first pixel array 12 are different from each other, and the alternating light-emitting region 121 may include at least two minimum repeating units. For example, as shown in FIG. 3, taking the minimum repeating unit including a red sub-pixel, a blue sub-pixel, and a green sub-pixel as an example, the alternating light-emitting region 121 may include two minimum repeating units. The first minimum repeating unit 1551 including sub-pixels 1211, 1213, and 1215 while the second minimum repeating unit 1552 including sub-pixels 1212, 1214, and 1216.

Figure 7:
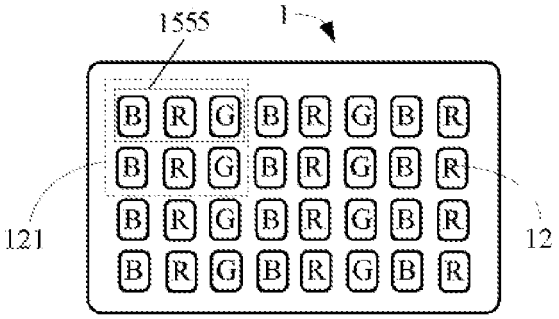
FIG. 7 is a pixel arrangement diagram of a light-transmissive display area according to an example.
Figure 8:
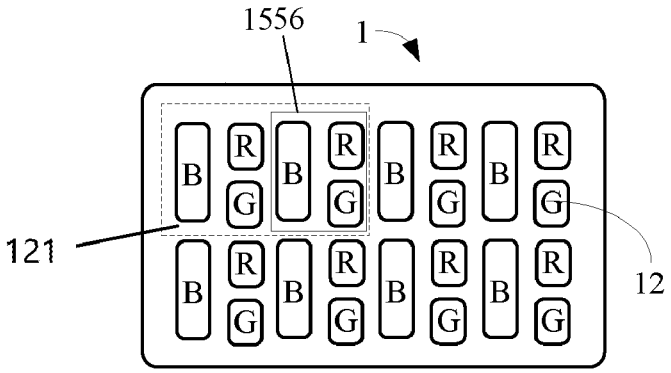
FIG. 8 is a pixel arrangement diagram of a light-transmissive display area according to an example.

For example, as shown in FIG. 7, the red sub-pixel, blue sub-pixel, and green sub-pixel may be arranged side by side. The minimum repeating unit is shown as 1555. Alternatively, in other embodiments as shown in FIG. 8, the red sub-pixel, blue sub-pixel, and the green sub-pixel may also be arranged in staggered arrangement. The minimum repeating unit is shown as 1556. Of course, when the minimum repeating unit further includes sub-pixels of other colors, there may be other arrangements, which is not limited in this disclosure.

Figure 9:
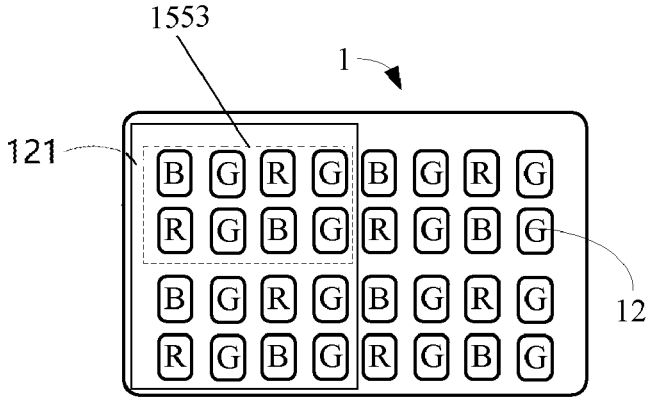
FIG. 9 is a pixel arrangement diagram of a light-transmissive display area according to an example.
Figure 10:
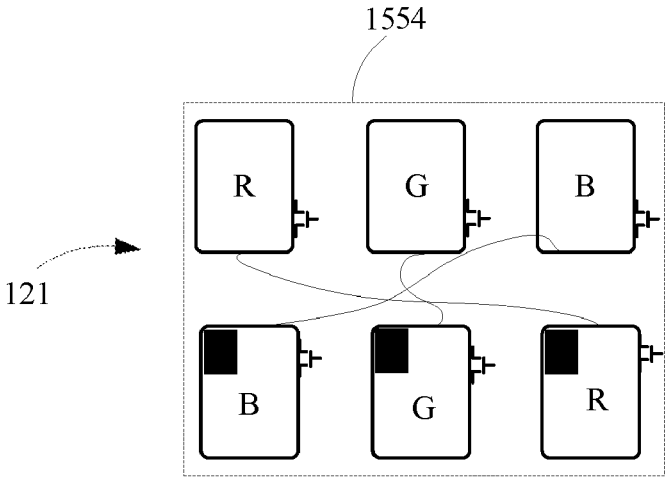
FIG. 10 is a structural schematic diagram of an alternating light-emitting region according to an example.
Figure 11:
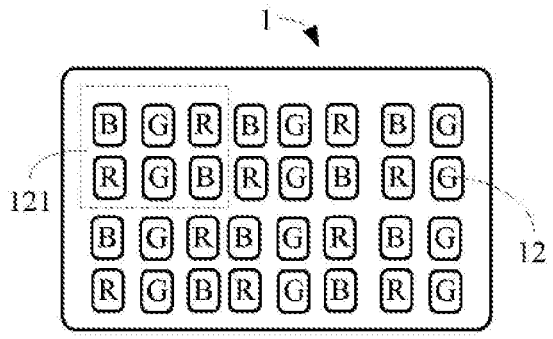
FIG. 11 is a pixel arrangement diagram of a light-transmissive display area according to an example.

In another embodiment, if the minimum repeating unit corresponding to the first pixel array 12 includes a plurality of sub-pixels, and each color corresponds to at least two sub-pixels, then the alternating light-emitting region 121 may include one or more minimum repeating units. For example, as shown in FIG. 6, the alternating light-emitting region 121 includes one minimum repeating unit 1553 including two blue sub-pixels, two red sub-pixels, and four green sub-pixels. A pixel arrangement of the light-transmissive display area 1 obtained by the combination of the minimum repeating unit shown in FIG. 6 is shown in FIG. 9. In another embodiment, the minimum repeating unit 1554 corresponding to the first pixel array 12 may also include two blue sub-pixels, two red sub-pixels, and two green sub-pixels. Based on this, if the alternating light-emitting region 121 shown in FIG. 10 includes one minimum repeating unit, then each blue sub-pixel is a sub-pixel group, each red sub-pixel is a sub-pixel group, each green sub-pixel is a sub-pixel group, and the two blue sub-pixel groups are connected in parallel to the same first pixel driving circuit 11, the two red sub-pixel groups are connected in parallel to the same first pixel driving circuit 11, the two green sub-pixel groups are connected in parallel to the same first pixel driving circuit 11. A pixel arrangement of the light-transmissive display area 1 obtained by the combination of the minimum repeating unit shown in FIG. 10 is shown in FIG. 11.

Figure 12:
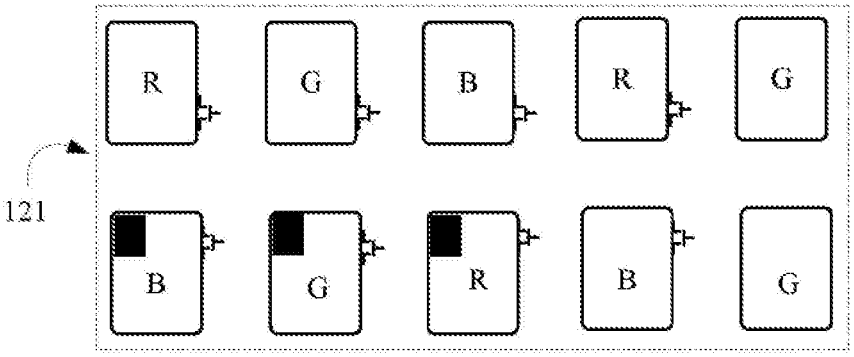
FIG. 12 is a schematic structural diagram of an alternating light-emitting region according to an example.

As shown in FIG. 12, in another embodiment, the alternating light-emitting region 121 may include integer numbers of minimum repeating units and at same time may further include other sub-pixels that cannot form a complete minimum repeating unit. In this embodiment, one sub-pixel group may be composed of sub-pixels of the same color located in the same row. For example, the two red sub-pixels located in an upper row in FIG. 12 form one sub-pixel group, the two green sub-pixels located in the upper row form one sub-pixel group, and one blue sub-pixel located in the upper row forms one sub-pixel group. The two blue sub-pixels located in a lower row form one sub-pixel group, the two green sub-pixels located in the lower row form one sub-pixel group, and one red sub-pixel located in the lower row forms one sub-pixel group. Furthermore, the blue sub-pixel group located in the upper row and the blue sub-pixel group located in the lower row can be connected in parallel to the same first pixel driving circuit 11. The red sub-pixel group located in the upper row and the red sub-pixel group located in the lower row can be connected in parallel to the same first pixel driving circuit 11, and the green sub-pixel group located in the upper row and the green sub-pixel group located in the lower row can be connected in parallel to the same first pixel driving circuit 11. When a plurality of sub-pixels are included in the same sub-pixel group, reference may be made to the embodiments shown in FIG. 4 and FIG. 6, which will not be repeated here. Of course, sub-pixels of the same color located in different rows may also form one sub-pixel group. This disclosure is not limited in this regard.

Figure 13:
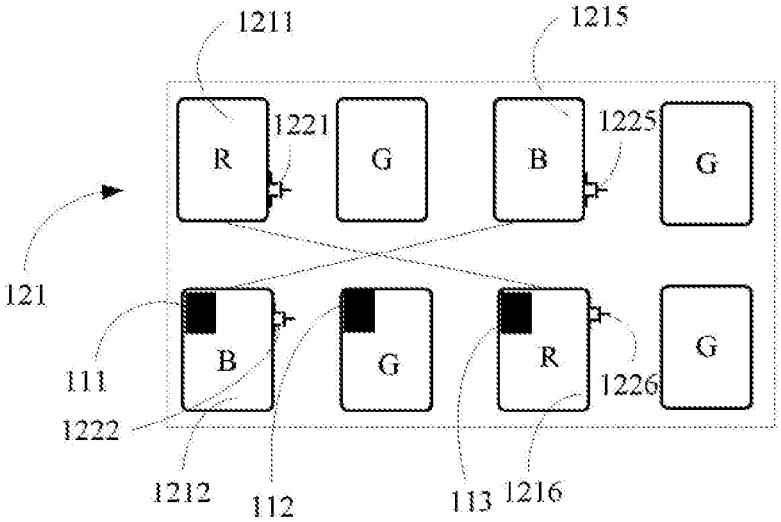
FIG. 13 is a schematic structural diagram of an alternating light-emitting region according to an example.

Based on the technical solution of the present disclosure, a specific alternating light-emitting form of the alternating light-emitting region 121 can be a cycle composed of two times of alternating light emission, or a cycle composed of three times of alternating light emission, or a cycle composed of more times of alternating light emission, which is not limited in the present disclosure. In an embodiment, in order to improve the refresh rate of the light-transmissive display area 1, the alternating light-emitting region 121 may alternately emit light twice in a cycle. As shown in FIG. 13, the alternating light-emitting region 121 may include even rows of sub-pixels, and the even rows of sub-pixels may include green sub-pixel groups and other preset color sub-pixel groups other than green, the preset color sub-pixel group includes one or more preset color sub-pixels located in the same row. The control circuit 2 can be used to control the switching circuits 122 connected with the preset color sub-pixel groups located in the odd rows and the switching circuits 122 connected with the preset color sub-pixel groups located in the even rows to alternately turn on, and to control the first pixel driving circuit so that the preset color sub-pixel groups in the odd rows and the preset color sub-pixel groups in the even rows in the alternating light-emitting region 121 emit light alternately.

Still as shown in FIG. 13, it is assumed that the alternating light-emitting region 121 may include a plurality of sub-pixels arranged in two rows and four columns. The preset color sub-pixel group may include red sub-pixels and blue sub-pixels, and the red sub-pixel located in the upper row forms one red sub-pixel group 1211, the red sub-pixel located in the lower row forms one red sub-pixel group 1216, the blue sub-pixel located in the upper row forms one blue sub-pixel group 1215, and the blue sub-pixel located in the lower row forms one blue sub-pixel group 1212. The red sub-pixel group 1211 and the red sub-pixel group 1216 are connected in parallel to the same first pixel driving circuit 113, and the blue sub-pixel group 1212 and the blue sub-pixel group 1215 are connected in parallel to the same first pixel driving circuit 111. Furthermore, the red sub-pixel group 1211 is connected with the first switching circuit 1221, the red sub-pixel group 1216 is connected with the sixth switching circuit 1226, the blue sub-pixel group 1212 is connected with the second switching circuit 1222, and the blue sub-pixel group 1215 is connected with the fifth switching circuit 1225.

The control circuit 2 can control the first switching circuit 1221, the sixth switching circuit 1226, and the first pixel driving circuit 113, so that the red sub-pixel group 1211 located in the upper row and the red sub-pixel group 1216 located in the lower row emit light alternately. Similarly, the control circuit 2 can control the second switching circuit 1222, the fifth switching circuit 1225, and the first pixel driving circuit 111, so that the blue sub-pixel group 1215 located in the upper row and the blue sub-pixel group 1212 located in the lower row alternately emit light, thereby realizing that the sub-pixel groups located in odd rows and the sub-pixel groups located in even rows of the preset color sub-pixel groups in the alternating light-emitting region 121 emit light alternately.

In the embodiment shown in FIG. 13, the alternating light-emitting region 121 may further include green sub-pixels located in the upper row and green sub-pixels located in the lower row. In one embodiment, the light-emitting frequency of the four green sub-pixels may be twice as the light-emitting frequency of the preset color sub-pixel group. For example, when the preset color sub-pixel groups in an odd row and the preset color sub-pixel groups in an even row in the alternating light-emitting region 121 as shown in FIG. 13 emit light alternately, the four green sub-pixels may be all in light-emitting state, regardless of whether the preset color sub-pixel groups currently located in the odd row are in light-emitting state or the preset color sub-pixel groups currently located in the even row are alternately in light-emitting state. Alternatively, in another embodiment, the four green sub-pixels may form green sub-pixel groups in pairs, and the light-emitting frequency of the green sub-pixel group may be consistent with the light-emitting frequency of the preset color sub-pixel group. For example, as shown in FIG. 13, the two green sub-pixels in the upper row form one green sub-pixel group, and the two green sub-pixels in the lower row form one green sub-pixel group. If the preset color sub-pixel group located in the lower row is in a light-emitting state, the green sub-pixel group located in the lower row is in the light-emitting state. Moreover, the preset color sub-pixel group located in the upper row and the green sub-pixel group located in the upper row can be switched to the light-emitting state. In some other implementations, other numbers of green sub-pixels may further form one sub-pixel group. For the connection relationship between multiple green sub-pixels, reference may be made to the embodiments shown in FIG. 4 and FIG. 6, and details are not described herein again.

It can be understood that, the first pixel array 12 may include one or more alternating light-emitting regions 121, and the light emission situation when the first pixel array 2 includes one alternating light-emitting region 121 has been described in detail in the above embodiment. The following will describe the light emission situation in which the first pixel array 12 includes a plurality of alternating light-emitting regions 121.

Figure 14:
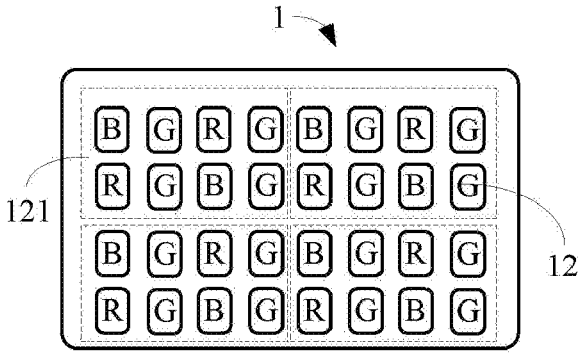
FIG. 14 is a pixel arrangement diagram of a light-transmissive display area according to an example.

As shown in FIG. 14, it is assumed that the first pixel array 12 may include four alternating light-emitting regions 121, and the first pixel driving circuits 11 and the switching circuits corresponding to each one of the alternating light-emitting regions 121 may be connected with the control circuit 2 respectively. The control circuit 2 can be used to control the switching circuits connected to sub-pixel groups at the same relative position in different alternating light-emitting regions to be turned on at the same time, and control the first pixel driving circuits 11 in each one of alternating light-emitting regions 121 to make the different alternating light-emitting regions 121 to emit light in the same alternating manner. Taking FIG. 14 as an example, the alternating light-emitting regions 121 may include an upper-left alternating light-emitting region, an upper-right alternating light-emitting region, a lower-left alternating light-emitting region, and a lower-right alternating light-emitting region. If preset color sub-pixel groups located in odd rows and preset color sub-pixel groups located in even rows in each of alternating light-emitting regions 121 alternately emit light, then make the sub-pixel groups located in the lower rows of the corresponding alternating light-emitting regions to be switched to the light-emitting state at the same time, and then also, at the same time, switch to the condition that the sub-pixel groups located in the upper rows of the corresponding alternating light-emitting regions to be switched to the light-emitting state. Therefore, for the entire light-transmissive display area 1, it can be expressed as preset color sub-pixel groups in the first row and the third row as well as preset color sub-groups in the second row and fourth row emit light alternately.

Figure 15:
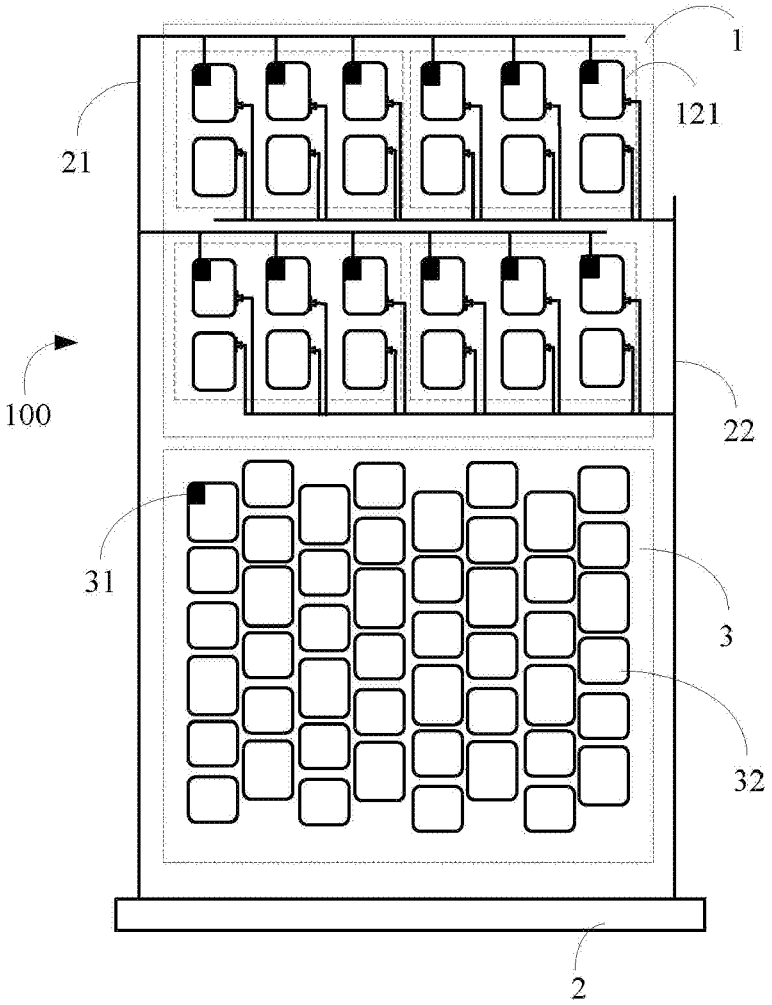
FIG. 15 is a schematic structural diagram of another display panel according to an example.

Based on the technical solution of the present disclosure, as shown in FIG. 15, the control circuit 2 may include a first control line 21 and a second control line 22. The first control line 21 can be used to input control signals to the first pixel driving circuits 11 and the second control line 22 can be used to input control signals to the switching circuits 122. Each of the switching circuits 122 can include a gate, a source, and a drain. The source is connected to the second control line 22, the drain is connected with an anode of the corresponding sub-pixel, and the gate is connected to the corresponding first pixel driving circuit 11. Only when the first pixel driving circuit 11 and the switching circuit 122 corresponding to the same sub-pixel group both control the sub-pixels to switch into display filling, the sub-pixels emit light. For example, in one embodiment, when the first control line 21 and the second control line 22 both input a high-level signal pulse signal to the same sub-pixel, the sub-pixel is switched to light-emitting state. Of course, according to different control modes of each control line, any control line may also be instructed that the corresponding sub-pixel is switched to light-emitting state when a low-pulse signal is input, which is not limited in the present disclosure.

In this embodiment, the first control line 21 and the second control line 22 may be located at the same side of the display panel 100. Alternately, as shown in FIG. 15, the first control line 21 and the second control line 22 may be located at different sides of the display panel 100. It can be specifically designed according to the spaces on both sides of the display panel 100.

Based on the technical solution of the present disclosure, the display panel 100 may further include a non-light-transmissive display area 3, and the non-light-transmissive display area 3 may include a second pixel driving circuit 31 and a second pixel array 32. The second pixel array 32 may include a plurality of sub-pixels, and each one of the plurality of sub-pixels sub-pixel corresponds to a second pixel driving circuit 31. The first pixel driving circuit 11 and the second pixel driving circuit 31 may input pulse signals through the same control line, or may input pulse signals through different control lines, which is not limited in the present disclosure.

In this embodiment, arrangement rules of the first pixel array 12 and the second pixel array 32 may be the same or different. Specifically, the arrangement rules can be determined according to the functions of the light-transmissive display area 1 and the non-light-transmissive display area 3, in which the light-transmissive display area 1 needs to make light to transmit, but the non-light-transmissive display area 3 is mainly used for display, which is not limited in this disclosure.

Figure 16:
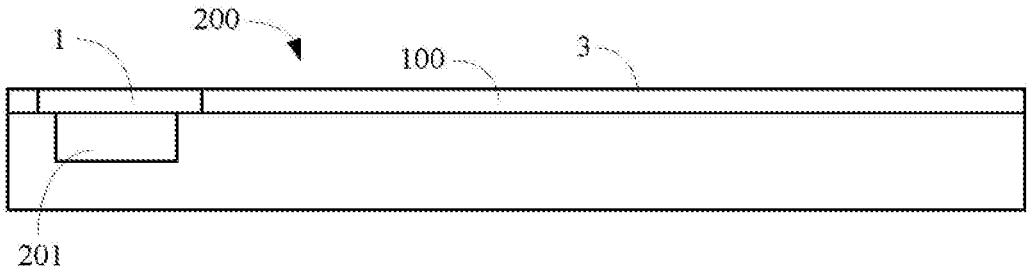
FIG. 16 is a schematic cross-sectional view of an electronic device according to an example.

Based on the display panel 100 provided in the above embodiment, the present disclosure further provides an electronic device 200. As shown in FIG. 16, the electronic device 200 may include a display panel 100 and a photosensitive device 201, and the photosensitive area of the photosensitive device 201 is set to correspond to the light-transmissive display area 1 of the display panel 100, in order to facilitate light transmission. In other words, the photosensitive area of the photosensitive device 201 is at least partially covered by the light-transmissive display area 1. In some embodiments, the photosensitive area of the photosensitive device 201 is fully covered by the light-transmissive display area 1. The photosensitive device 201 may include one or more of a camera, an ambient light sensor, and a distance sensor. The electronic device 200 may include devices such as a mobile phone terminal and a tablet terminal, and so on.

The technical solutions provided by the embodiments of the present disclosure may include the following beneficial effects:

It can be known from the above embodiments that in the light-transmissive display area, the plurality of sub-pixel groups in the alternating light-emitting region share the first pixel driving circuit, and meanwhile each sub-pixel group can be controlled independently by a switching circuit, which can realize alternating light emission between sub-pixel groups of the same color in the alternate light-emitting region, and then conduct image processing based on the images obtained by alternating light emission. This can obtain a higher resolution image, thereby improving the image resolution and the display quality while ensuring the light transmittance.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the apparatus or system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Those skilled in the art will readily contemplate other embodiments of the present disclosure after considering the specification and practicing the disclosure disclosed herein. This disclosure is intended to cover any variations, usages, or adaptive changes of this disclosure that follow the general principles of this disclosure and include the common general knowledge or conventional technical means in the technical field not disclosed by this disclosure. It is intended that the specification and examples be considered as exemplary only, with a true scope and spirit of the disclosure being indicated by the following claims.

It should be understood that the present disclosure is not limited to the precise structure that has been described above and illustrated in the accompanying drawings, and various modifications and changes may be made without departing from the scope thereof. The scope of the disclosure is limited only by the following claims.

What is claimed is:

1. A display panel, comprising:

a light-transmissive display area, comprising:

first pixel driving circuits;

a first pixel array comprising an alternating light-emitting region, wherein the alternating light-emitting region includes a plurality of sub-pixel groups, the plurality of sub-pixel groups include at least two colors, and each one of the plurality of sub-pixel groups includes at least one sub-pixel of the same color, at least two sub-pixel groups of the same color are connected in parallel to the same one of said first pixel driving circuits; and a plurality of switching circuits, each one of the plurality of switching circuits being connected with corresponding sub-pixel groups and first pixel driving circuit; and a control circuit connected with the plurality of the switching circuits and the first pixel driving circuits, wherein the control circuit is configured to control at least two switching circuits connected with the sub-pixel groups of the same color to alternately turn on and control the first pixel driving circuits to make the sub-pixel groups of the same color in the alternating light-emitting region to emit light alternately.

2. The display panel according to claim 1, wherein the alternating light-emitting region comprises at least two minimum repeating units; and wherein each minimum repeating unit includes sub-pixels of different colors.

3. The display panel according to claim 1, wherein the alternating light-emitting region comprises one or more minimum repeating units; and wherein each minimum repeating unit corresponding to the first pixel array comprises a plurality of sub-pixels of different colors, and each color corresponds to at least two sub-pixels.

4. The display panel according to claim 1, wherein each one of the plurality of sub-pixel groups comprises a plurality of sub-pixels, and the plurality of sub-pixels are connected in series to the same one of the plurality of switching circuits.

5. The display panel according to claim 4, wherein the plurality of sub-pixels are located in a same row.

6. The display panel according to claim 4, wherein the plurality of sub-pixels are located in different rows.

7. The display panel according to claim 4, wherein the sub-pixel groups comprise green sub-pixel groups.

8. The display panel according to claim 1, wherein each one of the plurality of sub-pixel groups comprises a plurality of sub-pixels, the plurality of sub-pixels are connected in parallel with each other, and each sub-pixel is connected to one of the plurality of switching circuits.

9. The display panel according to claim 8, wherein the sub-pixel groups comprise green sub-pixel groups.

10. The display panel according to claim 1, wherein each one of the plurality of switching circuits includes one or more transistors.

11. The display panel according to claim 1, wherein the alternating light-emitting region includes an even number of rows of sub-pixels, the plurality of sub-pixel groups include green sub-pixel groups and preset color sub-pixel groups, and the preset color sub-pixel groups include one or more preset color sub-pixels located in the same row;

the control circuit is configured to control switching circuits connected with preset color sub-pixel groups located in odd rows and switching circuits connected with preset color sub-pixel groups located in even rows to turn on alternately, and control the first pixel driving circuits to make the preset color sub-pixel groups located in odd rows and the preset color sub-pixel groups located in even rows in the alternating light-emitting region to alternately emit light.

12. The display panel according to claim 1, wherein the first pixel array includes a plurality of same alternating light-emitting regions, and the control circuit is configured to control the switching circuits connected with the sub-pixel groups at the same relative positions in respective alternating light-emitting regions of the plurality of same alternating light-emitting regions to turn on at the same time, and control the first pixel driving circuits so that the respective alternating light-emitting regions emit light in the same alternating manner.

13. The display panel according to claim 1, wherein the control circuit comprising:

a first control line configured to input control signals to the first pixel driving circuits;

a second control line configured to input control signals to the plurality of switching circuits, each one of the plurality of switching circuits including a gate, a source, and a drain, and the source is connected to the second control line, the drain is connected with an anode of corresponding sub-pixel, and the gate is connected to the first pixel driving circuits.

14. The display panel according to claim 13, wherein the first control line and the second control line are located at the same side of the display panel.

15. The display panel according to claim 13, wherein the first control line and the second control line are located at different sides of the display panel.

16. The display panel according to claim 1, wherein further comprising a non-light-transmissive display area, the non-light-transmissive display area comprising:

second pixel driving circuits;

a second pixel array, the second pixel array including a plurality of sub-pixels, and each one of the plurality of sub-pixels corresponds to one of the second pixel driving circuits.

17. The display panel according to claim 16, wherein an arrangement rule of the second pixel array is the same as an arrangement rule of the first pixel array.

18. The display panel according to claim 1, wherein the first pixel driving circuits comprise a 7T1C driving circuit, wherein the 7T1C driving circuit comprises 7 Thin Film Transistors (TFTs) and 1 storage capacitor.

19. An electronic device, comprising:

a display panel comprising:

a light-transmissive display area, comprising:

first pixel driving circuits;

a first pixel array comprising an alternating light-emitting region, wherein the alternating light-emitting region includes a plurality of sub-pixel groups, the plurality of sub-pixel groups include at least two colors, and each one of the plurality of sub-pixel groups includes at least one sub-pixel of the same color, at least two sub-pixel groups of the same color are connected in parallel to the same one of said first pixel driving circuits; and a plurality of switching circuits, each one of the plurality of switching circuits being connected with corresponding sub-pixel groups and first pixel driving circuit;

a control circuit connected with the plurality of the switching circuits and the first pixel driving circuits, wherein the control circuit is configured to control at least two switching circuits connected with the sub-pixel groups of the same color to alternately turn on and control the first pixel driving circuits to make the sub-pixel groups of the same color in the alternating light-emitting region to emit light alternately; and a photosensitive device, a photosensitive area of the photosensitive device is set to correspond to the light-transmissive display area.

20. The electronic device according to claim 19, wherein the photosensitive device comprises one or more of a camera, an ambient light sensor, and a distance sensor.

* * * * *